US010760873B2

(12) United States Patent
Sun et al.

(10) Patent No.: US 10,760,873 B2
(45) Date of Patent: Sep. 1, 2020

(54) GEAR-TYPE AIR RIFLE SLIDE STOP STRUCTURE

(71) Applicants: Wei Sun, Zhejiang (CN); Yecheng Wu, Zhejiang (CN); Xiaoqiang Shen, Zhejiang (CN); Guohua Jin, Zhejiang (CN); Dingfu Tang, Zhejiang (CN); Ye Sun, Zhejiang (CN); Xiaoping Ji, Zhejiang (CN)

(72) Inventors: Wei Sun, Zhejiang (CN); Yecheng Wu, Zhejiang (CN); Xiaoqiang Shen, Zhejiang (CN); Guohua Jin, Zhejiang (CN); Dingfu Tang, Zhejiang (CN); Ye Sun, Zhejiang (CN); Xiaoping Ji, Zhejiang (CN)

(73) Assignee: XISICO USA, INC, Houston, TX (US)

( * ) Notice: Subject to any disclaimer, the term of this patent is extended or adjusted under 35 U.S.C. 154(b) by 0 days.

(21) Appl. No.: 15/858,162

(22) Filed: Dec. 29, 2017

(65) Prior Publication Data

US 2020/0224996 A1 Jul. 16, 2020

(30) Foreign Application Priority Data

May 9, 2017 (CN) ..... 2017 2 0508021 U

(51) Int. Cl.
*F41B 11/647* (2013.01)

(52) U.S. Cl.
CPC ..... *F41B 11/647* (2013.01)

(58) Field of Classification Search
CPC ..... F41B 11/642; F41B 11/646; F41B 11/647
USPC ..... 124/66
See application file for complete search history.

(56) References Cited

U.S. PATENT DOCUMENTS 1,396,404 A * 11/1921 Burton ..... F41A 9/17 124/67
1,403,029 A * 1/1922 Hertlein ..... F41B 11/647 124/66
1,760,652 A * 5/1930 Loomis ..... F41B 11/646 124/67
1,830,763 A * 11/1931 Loomis ..... F41A 9/25 124/67
1,869,600 A * 8/1932 Loomis ..... F41A 17/58 124/67

(Continued)

*Primary Examiner* — Samir Abdosh
(74) *Attorney, Agent, or Firm* — Lai, Corsini & Lapus, LLC; Theodore Lapus

(57) ABSTRACT

The present disclosure relates to the field of air rifles, and particularly to a gear-type air rifle gear cock structure, including a air cylinder, a gear cock controller, a rack, and a rack reset spring, the gear cock controller is fixedly connected with the air cylinder, and the rack is arranged between the air cylinder and the gear cock controller; the air cylinder includes a air cylinder body, a piston, and a magazine, the air cylinder body has a hollow structure with an air chamber inside, the piston is arranged in the air chamber inside the air cylinder body, the magazine communicates with the air chamber through an outlet pipe; two ends of the rack are a piston fixing end and a spring fixing end respectively, the piston fixing end is connected with the piston through a lug arranged at the piston fixing end, the spring fixing end is connected with the rack reset spring, two ends of the rack reset spring are respectively fixed on the rack and the air cylinder.

10 Claims, 3 Drawing Sheets

(56) References Cited

U.S. PATENT DOCUMENTS

| | | | | | |
|---|---|---|---|---|---|
| 2,149,749 | A * | 3/1939 | Savage | F41B 11/647 | 473/569 |
| 3,370,581 | A * | 2/1968 | Hills | F41B 11/646 | 124/67 |
| 2007/0261689 | A1* | 11/2007 | Tai | F41B 11/646 | 124/67 |
| 2018/0112948 | A1* | 4/2018 | Iwasawa | F41B 11/642 | |

* cited by examiner

GEAR-TYPE AIR RIFLE SLIDE STOP STRUCTURE

BACKGROUND

Technical Field

The present invention relates to the field of air rifles, and particularly to a gear-type air rifle gear cock structure.

Background

The existing air rifles, utilizing a spring as power, require a linkage mechanism in operation to drive an air chamber inside the gun to compress the power spring, and to realize gear cock operation. For this type of guns, a relatively great force should be applied in a gear cock process, so that the gear cock of the gun can be realized, and for powerful guns, their gear cock process demands greater efforts. Moreover, in the gear cock process, the linkage mechanism cannot perform safety lock, that is, in the process of compressing the spring, if a shooter's hand is slipped from a pulling rod, the pulling rod will rebound, causing the gear cock action to hurt said shooter easily. It is quite necessary to design an air rifle gear cock structure which requires a relatively light force for the gear cock and has a safe gear cock process.

SUMMARY

One object of the present disclosure is to provide a gear-type air rifle gear cock structure to solve the problems referred in the Background.

The above technical object of the present disclosure is realized through the following technical solution.

A gear-type air rifle gear cock structure, including: an air cylinder, a gear cock controller, a rack, and a rack reset spring, the gear cock controller is fixedly connected with the air cylinder, and the rack is arranged between the air cylinder and the gear cock controller;

The air cylinder includes a air cylinder body, a piston, and a magazine, the air cylinder body has a hollow structure with an air chamber inside, the piston is arranged in the air chamber inside the air cylinder body, the magazine communicates with the air chamber through an outlet pipe;

Two ends of the rack are a piston fixing end and a spring fixing end respectively, the piston fixing end is connected with the piston through a lug arranged at the piston fixing end, the spring fixing end is connected with the rack reset spring, two ends of the rack reset spring are respectively fixed on the rack and the air cylinder.

Preferably, the gear cock controller includes a housing, a rocking bar, a rocking bar gear, a button, and a double-layer gear, the housing is provided with several insertion holes, so that rotating shafts of the rocking bar gear and the double-layer gear are fixed in the insertion holes, the double-layer gear is fixed in an axial direction of the insertion hole, the rocking bar gear is not fixed in the axial direction of the insertion hole, two ends of the rotating shaft of the rocking bar gear are connected with the button and the rocking bar respectively; the rocking bar and the button are arranged outside the housing; the double-layer gear includes a first gear and a second gear which are coaxially stacked with each other, a distance between axle centers of the first gear and the rocking bar gear is equal to a sum of nominal radii of the two, and the second gear is engaged with the rack.

In the present solution, through the gear rack mechanism, an conventional linkage is for gear cocking is replaced with a transmission mode of driving the rocking bar gear and the double-layer gear by the rocking bar, the force of the user to gear cock is greatly reduced, and the risk from the gear cock is decreased. By switching the gear cock and the standby state through the button, the performance of the gun is further improved.

Preferably, the housing includes a fixed shell and a protecting shell, the protecting shell is fixedly connected with the air cylinder through the fixed shell.

Preferably, the housing is internally provided with an anti-reverse paddle, the anti-reverse paddle includes a limit section, a hinge section, and a driving lever section, the anti-reverse paddle is hinge-fixed in the housing through the hinge section, and has a function of rotating with the hinge section as an axle center, the driving lever section extends out from the housing, and the limit section is provided with a top head for positioning the rocking bar gear.

By arranging the anti-reverse paddle, the rack will not rebound in the process of gear cocking, therefor the safety is improved, moreover, the distance of gear cocking can be controlled arbitrarily, improving the playability of the gun.

Preferably, one end of the driving lever section located in the housing is provided with a spring seat, the spring seat is abutted against a paddle spring, and the paddle spring is fixed in the housing.

Preferably, the rotating shaft of the rocking bar gear is provided with a ratchet for cooperation with the anti-reverse paddle.

Preferably, the ratchet is in sliding connection with the air cylinder.

Preferably, the rack is in sliding connection with the gear cock controller.

Preferably, the rack is in sliding connection with the gear cock controller through a slide groove provided on the fixed shell.

Preferably, the housing is provided with a limit platform for serving a limit function to the anti-reverse paddle.

To sum up, the beneficial effects of the present disclosure lie in:

(1) The gear-type air rifle gear cock structure of the present disclosure, using the gear rack mechanism in place of the conventional linkage compression bar mechanism, solves the problem that spring gun gear cock is too heavy, and meanwhile has the anti-backward function in the gear cock process, i.e. at any position in the gear cock process, the position of the rack can be locked through the anti-reverse rotary paddle, preventing the rack from rebounding.

(2) The gear-type air rifle gear cock structure of the present disclosure facilitates modifications to the air rifles with the conventional linkage mechanism, and for the modifications, all it needs is to detach the original linkage mechanism, and install the gear cock controller, the rack, and the rack reset spring.

DETAILED DESCRIPTION OF ILLUSTRATED EMBODIMENTS

The following specific embodiments are merely for illustrating the present disclosure, rather than limiting the present disclosure. A person skilled in the art, upon reading the present description, can make modifications, without inventive contribution, to the present embodiments as required, and the modifications are protected by the Patent Law as long as they are within the scope of the claims of the present disclosure.

Below the present disclosure is described in detail with embodiments in combination with the accompanying drawing.

Embodiment 1

Figure 1:
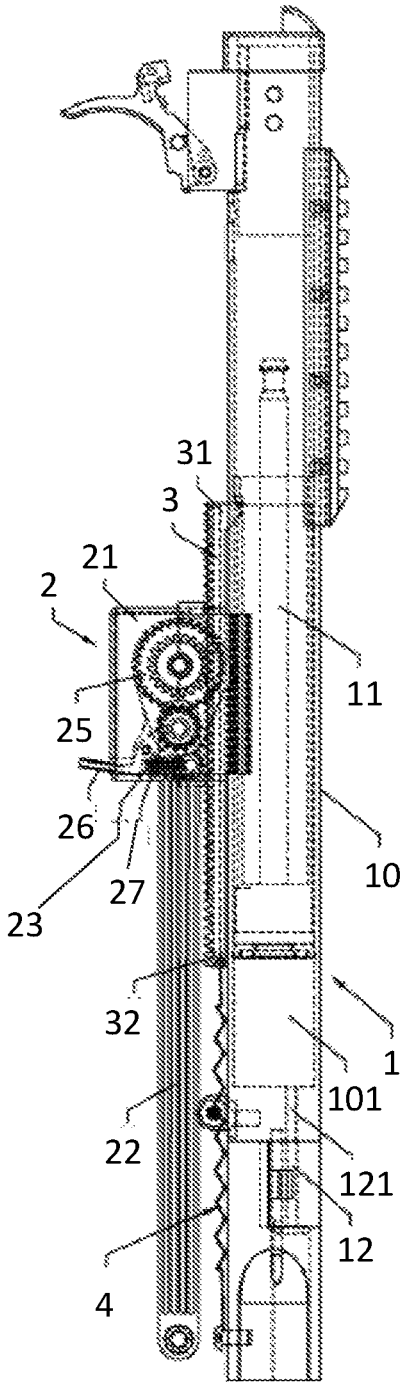
FIG. 1 is a structural schematic diagram of the present disclosure.
Figure 2:
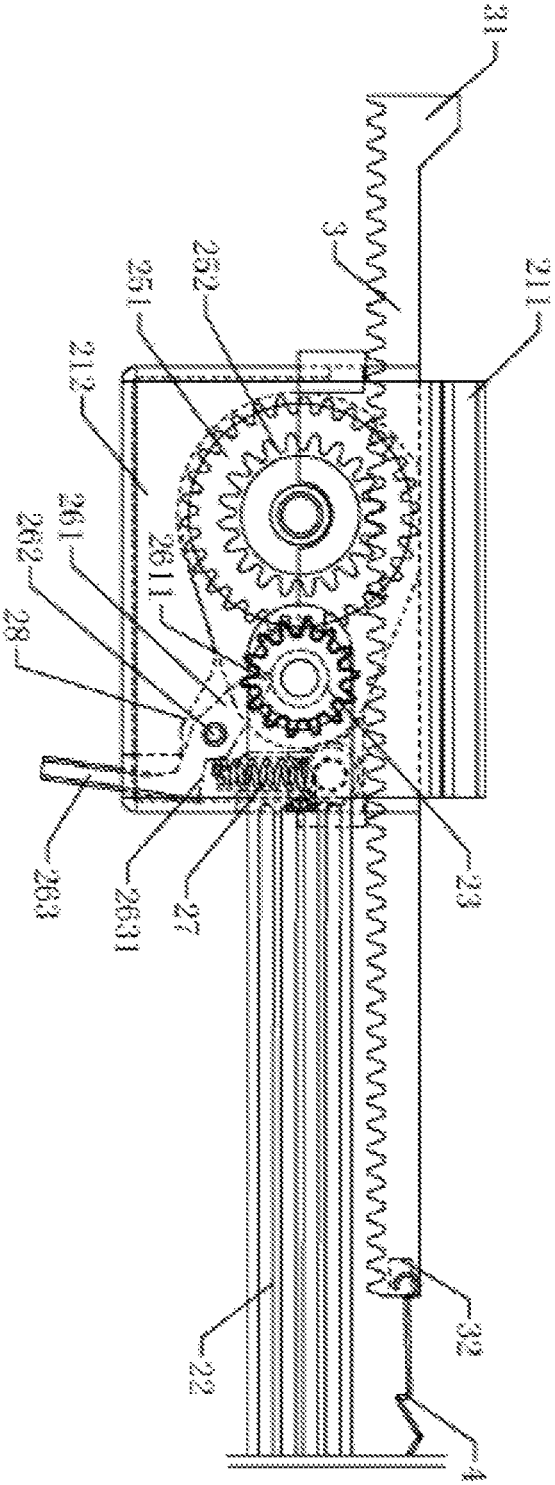
FIG. 2 is a structural schematic diagram of a gear cock controller in the present disclosure.
Figure 3:
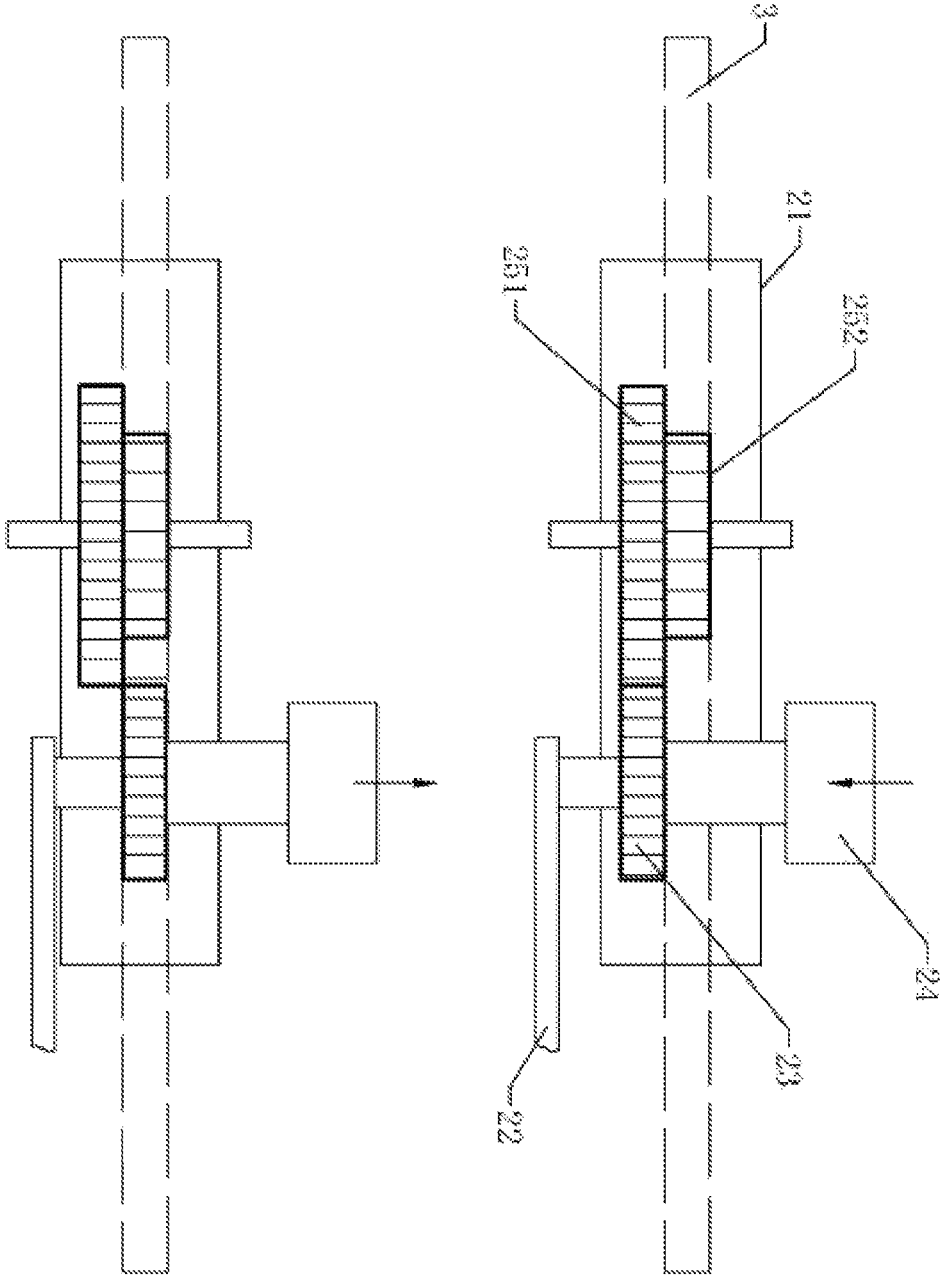
FIG. 3 is a use schematic diagram of the present disclosure.

According to FIG. 1 to FIG. 3, a gear-type air rifle gear cock structure includes: a air cylinder 1, a gear cock controller 2, a rack 3, and a rack reset spring 4, the gear cock controller 2 is fixedly connected with the air cylinder 1, and the rack 3 is arranged between the air cylinder 1 and the gear cock controller 2;

The air cylinder 1 includes a air cylinder body 10, a piston 11, and a magazine 12. The air cylinder body 10 has a hollow structure with an air chamber 101 inside. The piston 11 is arranged in the air chamber 101 inside the air cylinder body 10. The magazine 12 communicates with the air chamber 101 through an outlet pipe 121;

Two ends of the rack 3 are a piston fixing end 31 and a spring fixing end 32 respectively. The piston fixing end 31 is connected with the piston 11 through a lug arranged at the piston fixing end 31. The spring fixing end 32 is connected with the rack reset spring 4. Two ends of the rack reset spring 4 are respectively fixed on the rack 3 and the air cylinder 1.

According to FIG. 1 and FIG. 2, the gear cock controller 2 includes a housing 21, a rocking bar 22, a rocking bar gear 23, a button 24, and a double-layer gear 25. The housing 21 is provided with several insertion holes, so that rotating shafts of the rocking bar gear 23 and the double-layer gear 25 are fixed in the insertion holes. The double-layer gear 25 is fixed in an axial direction of the insertion hole, while the rocking bar gear 23 is not fixed in the axial direction of the insertion hole. Two ends of the rotating shaft of the rocking bar gear 23 are connected with the button 24 and the rocking bar 22 respectively. The rocking bar 22 and the button 24 are arranged outside the housing 21; the double-layer gear 25 includes a first gear 251 and a second gear 252 which are coaxially stacked with each other. A distance between axle centers of the first gear 251 and the rocking bar gear 23 is equal to a sum of nominal radii of the two, and the second gear 252 is engaged with the rack 3.

The housing 21 is internally provided with an anti-reverse paddle 26. The anti-reverse paddle 26 includes a limit section 261, a hinge section 262, and a driving lever section 263. The anti-reverse paddle 26 is hinge-fixed in the housing 21 through the hinge section 262, and has the function of rotating with the hinge section 262 as an axle center. The driving lever section 263 extends out from the housing 21. The limit section 261 is provided with a top head 2611 for positioning the rocking bar gear 23. One end of the driving lever section 263 located in the housing 21 is provided with a spring seat 2631. The spring seat 2631 is abutted against a paddle spring 27. The paddle spring 27 is fixed in the housing 21. The rotating shaft of the rocking bar gear 23 is provided with a ratchet for cooperation with the anti-reverse paddle 26. The ratchet is arranged to be concentrically fixed with the rocking bar gear 23. The housing 21 is provided with a limit platform 28 for serving a limit function to the anti-reverse paddle 26.

The housing 21 includes a fixed shell 211 and a protecting shell 212. The protecting shell 212 is fixedly connected with the air cylinder 1 through the fixed shell 211. The rack 3 is in sliding connection with the gear cock controller 2 through a slide groove provided on the fixed shell 211.

According to FIG. 3, the present mechanism is defined into a gear cock use state and a standby use state, and the two states can be switched through the button 24. When in the gear cock use state, the rocking bar gear 23 is engaged with the first gear 251, and the rocking bar gear 23 is driven by rotating the rocking bar 22 to drive the double-layer gear 25, so that the second gear 252 drives the rack 3 to slide, and the rack 3, while sliding, drives the piston 11 to move which completes the gear cock operation. During the gear cock operation, the anti-reverse paddle 26 is abutted against the ratchet through the top head 2611 under the effect of the paddle spring 27, realizing the unidirectional rotation of the rocking bar gear 23, so that it is ensured that the rack 3 will not rebound. When the gear cock is not needed, the button 24 is toggled, so that the rocking gear 23 is no longer engaged with the first gear 251. The driving lever section 263 of the anti-reverse paddle 26 is toggled, the top head 2611 is released, and the rack 3 is reset by the rack reset spring 4.

Embodiment 2

Different from the above embodiment 1, the rack 3 is in sliding connection with the air cylinder 1.

What is claimed is:

1. A gear-type air rifle gear cock structure, comprising: a air cylinder (1), a gear cock controller (2), a rack (3), and a rack reset spring (4), the gear cock controller (2) being fixedly connected with the air cylinder (1), and the rack (3) being arranged between the air cylinder (1) and the gear cock controller (2);

wherein the air cylinder (1) comprises a air cylinder body (10), a piston (11), and a magazine (12), the air cylinder body (10) is a hollow structure with an air chamber (101) inside, the piston (11) is arranged in the air chamber (101) inside the air cylinder body (10), the magazine (12) communicates with the air chamber (101) through an outlet pipe (121);

wherein two ends of the rack (3) are a piston fixing end (31) and a spring fixing end (32) respectively, the piston fixing end (31) is connected with the piston (11), the spring fixing end (32) is connected with the rack reset spring (4), two ends of the rack reset spring (4) are respectively fixed on the rack (3) and the air cylinder (1).

2. The gear-type air rifle gear cock structure of claim 1, wherein the gear cock controller (2) comprises a housing (21), a rocking bar (22), a rocking bar gear (23), a button (24), and a double-layer gear (25), the housing (21) is provided with several insertion holes, so that rotating shafts of the rocking bar gear (23) and the double-layer gear (25) are fixed in the insertion holes, the double-layer gear (25) is fixed in an axial direction of the insertion hole, the rocking bar gear (23) is not fixed in the axial direction of the insertion hole, two ends of the rotating shaft of the rocking bar gear (23) are connected with the button (24) and the rocking bar (22) respectively; the double-layer gear (25) comprises a first gear (251) and a second gear (252) which are coaxially stacked with each other, a distance between axle centers of the first gear (251) and the rocking bar gear (23) is equal to a sum of nominal radii of the two, and the second gear (252) is engaged with the rack (3).

3. The gear-type air rifle gear cock structure of claim 2, wherein the housing (21) comprises a fixed shell (211) and a protecting shell (212), the protecting shell (212) is fixedly connected with the air cylinder (1) through the fixed shell (211).

4. The gear-type air rifle gear cock structure of claim 2, wherein the housing (21) is internally provided with an anti-reverse paddle (26), the anti-reverse paddle (26) comprises a limit section (261), a hinge section (262), and a driving lever section (263), the anti-reverse paddle (26) is hinge-fixed in the housing (21) through the hinge section (262), and has a function of rotating with the hinge section (262) as an axle center, the driving lever section (263) extends out from the housing (21), and the limit section (261) is provided with a top head (2611) for positioning the rocking bar gear (23).

5. The gear-type air rifle gear cock structure of claim 3 or 4, wherein one end of the driving lever section (263) located in the housing (21) is provided with a spring seat (2631), the spring seat (2631) is abutted against a paddle spring (27), and the paddle spring (27) is fixed in the housing (21).

6. The gear-type air rifle gear cock structure of claim 5, wherein the rotating shaft of the rocking bar gear (23) is provided with a ratchet for cooperation with the anti-reverse paddle (26).

7. The gear-type air rifle gear cock structure of claim 6, wherein the rack (3) is in sliding connection with the air cylinder (1).

8. The gear-type air rifle gear cock structure of claim 6, wherein the rack (3) is in sliding connection with the gear cock controller (2).

9. The gear-type air rifle gear cock structure of claim 3, wherein the rack (3) is in sliding connection with the gear cock controller (2) through a slide groove provided on the fixed shell (211).

10. The gear-type air rifle gear cock structure of claim 5, wherein the housing (21) is provided with a limit platform (28) for serving a limit function to the anti-reverse paddle (26).

* * * * *